US005867015A

United States Patent [19]

Corsi et al.

[11] Patent Number: 5,867,015

[45] Date of Patent: Feb. 2, 1999

[54] LOW DROP-OUT VOLTAGE REGULATOR WITH PMOS PASS ELEMENT

[75] Inventors: Marco Corsi; Robert B. Borden, both of Plano, Tex.; Michael R. Kay, Greensboro, N.C.; Nicolas Salamina, Dallas, Tex.; Gabriel A. Rincon, Margate, Fla.

[73] Assignee: Texas Instruments Incorporated, Dallas, Tex.

[21] Appl. No.: 992,706

[22] Filed: Dec. 17, 1997

Related U.S. Application Data

[60] Provisional application No. 60/033,679, Dec. 19, 1996.

[51] Int. Cl.[6] ..... G05F 3/16

[52] U.S. Cl. ..... 323/316; 327/542

[58] Field of Search ..... 327/542; 365/226; 323/316, 314, 313

[56] References Cited

U.S. PATENT DOCUMENTS

| | | | |
|---|---|---|---|
| 4,954,769 | 9/1990 | Kalthoff | 323/313 |
| 5,751,639 | 5/1998 | Ohsawa | 365/226 |

*Primary Examiner*—Shawn Riley
*Attorney, Agent, or Firm*—Alan K. Stewart; Wade James Brady, III; Richard L. Donaldson

[57] ABSTRACT

A voltage regulator circuit includes: a first MOS transistor 12 coupled between a voltage supply line and an output node 44, the first MOS transistor 12 providing a stable voltage on the output node 44; a source follower 24 coupled to a gate of the first MOS transistor 12; an amplifier 38 coupled to a gate of the source follower 24 for controlling the response of the first MOS transistor 12; negative feedback circuitry coupled between the output node 44 and the amplifier 38, the feedback circuitry providing feedback to the amplifier 38; a current conveyer 46 coupled to the first MOS transistor 12; and positive feedback circuitry 26 coupled between the current conveyer 46 and the source follower 24.

5 Claims, 1 Drawing Sheet

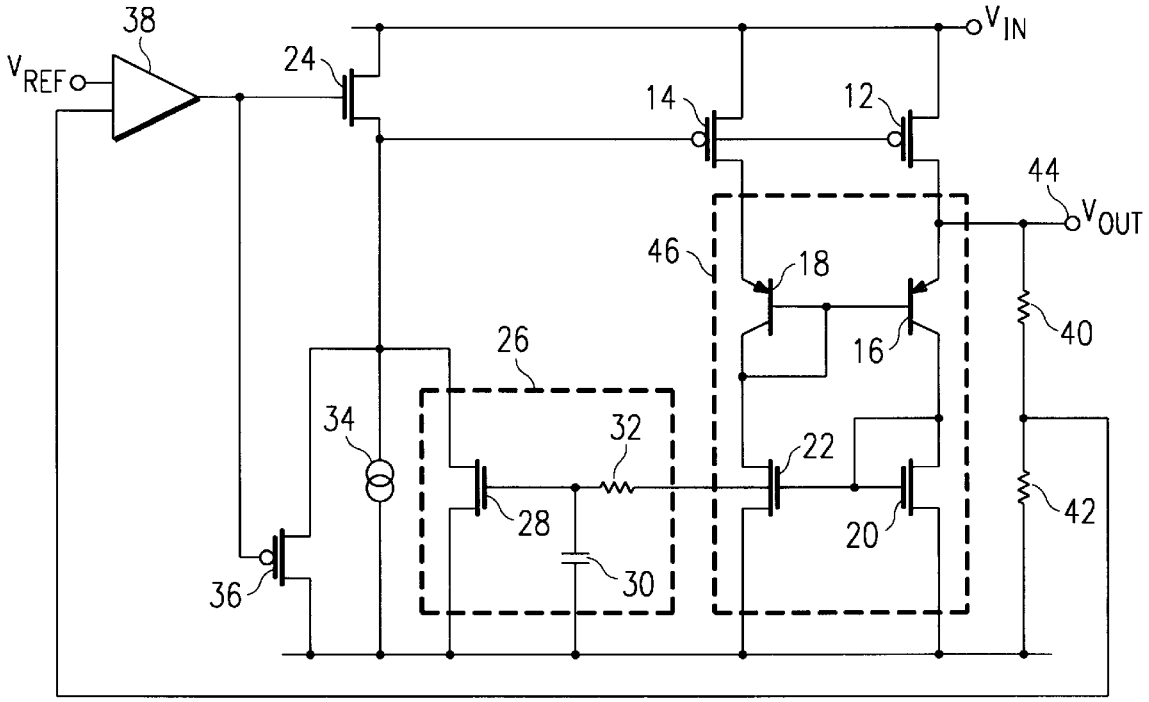
38
$V_{REF}$
24
$V_{IN}$
14
12
44
$V_{OUT}$
46
18
16
40
26
34
32
22
28
20
42
30
36

LOW DROP-OUT VOLTAGE REGULATOR WITH PMOS PASS ELEMENT

This application claims priority under 35 USC § 119 (e) (1) of provisional application Ser. No. 60/033,679, filed Dec. 19, 1996.

FIELD OF THE INVENTION

This invention generally relates to electronic systems and in particular it relates to voltage regulators.

BACKGROUND OF THE INVENTION

The function of a voltage regulator is to take a varying input voltage supply and generate a stable output voltage. The efficiency of modern power supply systems, especially battery operated ones, is directly related to the useable operating voltage and current over head required by the system's voltage regulator. The useable operating voltage is called the "drop-out" voltage, which is the difference between the input and output voltages of the regulator while the regulator still maintains regulation. The smaller this difference, the more efficient the system. Additionally, batteries can supply only a finite amount of charge, so the more quiescent current the regulator uses (which is wasted current as far as the system is concerned), the less life the battery will have and therefore the system will be less efficient.

SUMMARY OF THE INVENTION

Generally, and in one form of the invention, the voltage regulator circuit includes: a first MOS transistor connected between a voltage supply line and an output node, the first MOS transistor providing a stable voltage on the output node; a source follower coupled to a gate of the first MOS transistor; an amplifier coupled to a gate of the source follower for controlling the response of the first MOS transistor; negative feedback circuitry coupled between the output node and the amplifier, the feedback circuitry providing feedback to the amplifier; a current conveyer coupled to the first MOS transistor; and positive feedback circuitry coupled between the current conveyer and the source follower.

BRIEF DESCRIPTION OF THE DRAWINGS

In the drawings:

The FIGURE is a schematic circuit diagram of a preferred embodiment low drop-out (LDO) voltage regulator with PMOS pass element.

DETAILED DESCRIPTION OF PREFERRED EMBODIMENTS

Referring to the FIGURE, a circuit diagram of a preferred embodiment low drop-out (LDO) voltage regulator with PMOS pass element according to the present invention is illustrated. This preferred embodiment allows an LDO voltage regulator to be compensated while only consuming small currents and substantially improving the load regulation. The circuit includes PMOS pass device 12 (PMOS transistor); PMOS transistor 14; PNP transistors 16 and 18; NMOS transistors 20 and 22; NMOS transistor 24; positive feedback circuit 26 which includes NMOS transistor 28, capacitor 30, and resistor 32; current source 34; PMOS transistor 36; error amplifier 38 (operational amplifier), resistors 40 and 42, voltage reference $V_{REF}$, output voltage $V_{OUT}$, and input voltage $V_{IN}$.

The operation of the device is explained with reference to the preferred embodiment shown in the FIGURE. The output voltage $V_{OUT}$ is regulated by pass transistor 12. The error amp 38, which is an operational amplifier, controls transistor 12 through transistor 24. When the input voltage $V_{IN}$ changes or the current being drawn from an external load at node 44 changes, the output voltage $V_{OUT}$ begins to change causing the voltage across the second resistor 42 to change. The error amp 38 then adjusts the gate voltage of transistor 24 so that the output voltage $V_{OUT}$ is maintained in the desired range.

Current mirror transistor 14 monitors the current of transistor 12. In the preferred embodiment, the ratio of transistor 14 to transistor 12 is such that the current in transistor 14 is only a small fraction of the current in transistor 12 (for example 1:1000). PNP transistors 16 and 18 together with NMOS transistors 20 and 22 form a current conveyor 46 which forces the current in PNP transistors 20 and 22 to be the same. The current conveyor ensures that the $V_{DS}$ and $V_{GS}$ of transistors 12 and 14 are the same. Since the $V_{GS}$ of transistors 12 and 14 are the same, the currents in PNP transistors 16 and 18 are the same. The current in the current conveyor 46 is equal to the current in transistor 14.

The current conveyor current is mirrored to transistor 28. Transistor 28 is larger than transistors 20 and 22 in order to provide sufficient current for the source follower transistor 24 which drives output transistor 12. Transistor 24 is an isolated natural NMOS with a low $V_T$. Resistor 32 and capacitor 30 provide frequency compensation for the positive feedback to make sure the positive feedback never overcomes the negative feedback so that the circuit does not oscillate.

The current conveyor performs two functions. First, it ensures that the external pole and the internal pole remain separated for stability. Second, the positive feedback improves the load regulation by modulating the $V_{GS}$ of transistor 24 proportionately with the $V_{GS}$ of transistor 12. This compensates the output impedance of the circuit.

If there is no output current at output node 44, there will be no current mirrored to transistor 28. Therefore, in order to make sure that there is some current in transistor 24, current source 34 pulls on transistor 24 so that the circuit works where there is no load at output node 44. In the preferred embodiment, current source 34 provides only a small current on the order of one micro amp. With this small current, the power consumption of the circuit will be extremely small when there is no load on the output. This is an important feature for battery powered devices.

Transistor 36 is used to enhance the slew rate of the circuit. Transistor 36 allows the circuit to come back into regulation quickly when there is a rapid change in load. Transistor 36 turns on and helps the transient response when going from no load at output node 44 to a full load or some load condition at node 44.

While this invention has been described with reference to an illustrative embodiment, this description is not intended to be construed in a limiting sense. Various modifications and combinations of the illustrative embodiment, as well as other embodiments of the invention, will be apparent to persons skilled in the art upon reference to the description. It is therefore intended that the appended claims encompass any such modifications or embodiments.

What is claimed is:

1. A voltage regulator circuit comprising:

a first MOS transistor coupled between a voltage supply line and an output node, the first MOS transistor providing a stable voltage on the output node;

a source follower coupled to a gate of the first MOS transistor;

a current source coupled to the source follower;

an amplifier coupled to a gate of the source follower for controlling the response of the first MOS transistor;

negative feedback circuitry coupled between the output node and the amplifier, the feedback circuitry providing feedback to the amplifier;

a current conveyer coupled to the first MOS transistor; and positive feedback circuitry coupled between the current conveyer and the source follower.

2. The circuit of claim 1 wherein the current conveyer comprises:

a second MOS transistor having a gate coupled to the gate of the first MOS transistor;

a first bipolar transistor coupled to the first MOS transistor;

a second bipolar transistor coupled to the second MOS transistor, a base of the second bipolar transistor is coupled to a base of the first bipolar transistor;

a third MOS transistor coupled to the first bipolar transistor; and a fourth MOS transistor coupled to the second bipolar transistor and to the base of the first bipolar transistor, a gate of the fourth MOS transistor coupled to a gate of the third MOS transistor and to the first bipolar transistor.

3. The circuit of claim 1 wherein the positive feedback circuitry comprises:

a positive feedback MOS transistor coupled to the source follower;

a resistor coupled between the current conveyer and a gate of the positive feedback MOS transistor; and a capacitor coupled to the gate of the positive feedback MOS transistor.

4. The circuit of claim 1 wherein the negative feedback circuitry comprises:

a first resistor having a first end coupled to the output node and a second end coupled to the amplifier; and a second resistor coupled to the second end of the first resistor.

5. A voltage regulator circuit comprising:

a MOS transistor coupled between a voltage supply line and an output node, the MOS transistor providing a stable voltage on the output node;

a source follower coupled to a gate of the MOS transistor;

an amplifier having an output coupled to a gate of the source follower for controlling the response of the MOS transistor;

negative feedback circuitry coupled between the output node and an input of the amplifier; and a slew rate enhancement transistor coupled to the source follower, a gate of the slew rate enhancement transistor is coupled to the output of the amplifier.

* * * * *